US008802979B2

(12) United States Patent
Ziobro

(10) Patent No.: US 8,802,979 B2
(45) Date of Patent: Aug. 12, 2014

(54) TAMPER-RESISTANT SELF-CONTAINED RECEPTACLE

(76) Inventor: David J. Ziobro, Fayetteville, GA (US)

( * ) Notice: Subject to any disclaimer, the term of this patent is extended or adjusted under 35 U.S.C. 154(b) by 239 days.

(21) Appl. No.: 12/897,694

(22) Filed: Oct. 4, 2010

(65) Prior Publication Data

US 2011/0079414 A1 Apr. 7, 2011

Related U.S. Application Data

(60) Provisional application No. 61/248,493, filed on Oct. 4, 2009.

(51) Int. Cl.
*H01R 13/46* (2006.01)
*H01R 24/22* (2011.01)
*H01R 13/447* (2006.01)

(52) U.S. Cl.
CPC ..... *H01R 24/22* (2013.01); *H01R 13/447* (2013.01)
USPC ..... 174/53; 174/60; 439/535

(58) Field of Classification Search
CPC ..... H01R 4/22; H01R 13/447; H01R 13/44; H01R 24/22; H01R 24/20; H01R 25/003; H01R 24/78
USPC ..... 174/53, 64, 59, 51, 78, 50, 68.3, 785, 174/58, 60, 61; 439/92, 98, 100, 106–109, 439/386, 535, 620.21
See application file for complete search history.

(56) References Cited

U.S. PATENT DOCUMENTS 2,768,232 A * 10/1956 Kwake ..... 174/51
3,029,405 A * 4/1962 Buchanan ..... 439/95
3,725,580 A * 4/1973 Thompson et al. ..... 174/38
4,500,746 A * 2/1985 Meehan ..... 174/503
5,221,211 A * 6/1993 Leong ..... 439/106
5,541,363 A * 7/1996 Weise et al. ..... 174/50
6,179,634 B1 1/2001 Hull et al.
6,307,152 B1 * 10/2001 Bonilla et al. ..... 174/483
6,979,779 B2 * 12/2005 Grady ..... 174/50
7,053,296 B2 * 5/2006 Drane et al. ..... 174/483
7,160,147 B1 * 1/2007 Stephan ..... 439/535
7,394,019 B2 7/2008 Gesue
7,736,175 B1 * 6/2010 Savicki et al. ..... 439/535
7,744,407 B1 * 6/2010 Jerry ..... 439/535

OTHER PUBLICATIONS

Carlon Company, "Carton Floor Boxes and Covers", catalog, Oct. 2007, pp. 13-14, Lamson and Sessions, 2007, US.
Pass & Seymour Company, "Self-contained Devices", catalog, Sep. 2005, pp. 3,4,6, Pass&Seymour, 2005, US.

* cited by examiner

*Primary Examiner* — Angel R Estrada
*Assistant Examiner* — Dimary Lopez Cruz
(74) *Attorney, Agent, or Firm* — Lynda Kouroupis

(57) ABSTRACT

A tamper-resistant self-contained receptacle (TRSCR) provides two sets of contacts for connecting two separate cables in a daisy-chain configuration. A TRSCR is configured for insertion into a single bore hole and is compatible with both metal-clad (MC) and non-metal sheath (NMS) cable. A base providing two sets of contacts, each having hot, neutral and ground contacts, can couple to two doors so that each set is covered. A ground contact can include an extended clip for connection to the metal clad of an MC cable. A door can be configured to receive an MC cable or a NMS cable; or a universal door can be provided. Thus, a TRSCR is configured to provide a separate entry and a separate strain relief for each connected cable. A TRSCR can be coupled to a floor ring when installed in flooring, or an adapter collar when installed in a stone surface.

9 Claims, 9 Drawing Sheets

TAMPER-RESISTANT SELF-CONTAINED RECEPTACLE

CROSS-REFERENCE TO RELATED APPLICATIONS

This application claims priority from U.S. Provisional Application No. 61/248,493, entitled "Tamper-Resistant Self-Contained Receptacle for Use with Either Non-metallic Sheathed or Metal Clad Cables" filed by Ziobro on Oct. 4, 2009, which is herein incorporated in its entirety by reference.

FIELD OF INVENTION

This invention relates generally to electrical outlets and more particularly to self-contained receptacles.

BACKGROUND OF INVENTION

Historically, self-contained receptacles have been deployed in pre-manufactured and mobile housing, structures in which placement of electrical outlets can be constrained by spatial limitations. However, more recently their use has been expanded to include traditional housing as well as commercial buildings and churches. Self-contained receptacles facilitate the use of electronic accessories in areas such as window sills, mantles, countertops, and floors without the use of unsightly and potentially hazardous extension cords.

In many applications, self-contained receptacles are configured in a "daisy chain" arrangement in which power enters the receptacle, provides power to the receptacle, and then exits the receptacle to provide power for a separate device. In general, prior art receptacles operated in this manner require that a single power cord enter the receptacle, electrically connect to the receptacle through an insulation displacement connection, then exit the receptacle. Oftentimes the power cord must enter and exit through a single receptacle aperture, requiring the power cord to be pulled through, bent and pushed back through. While fit for their intended purposes, receptacles using the insulation displacement connection method provide less secure electrical connections than those that use terminal screws. In addition, insulation displacement connections can make rewiring a receptacle more difficult and can be prone to wire breakage as the cord must be unbent and bent during the rewiring process.

Prior art self-contained receptacles that do provide terminal screws for improved electrical connectivity provide but a single screw for connection of both entering and exiting hot wires, a single screw for both neutral wires and a single screw for both ground wires. Sharing a screw between entering and exiting wires can make receptacle wiring time-consuming, as both wires have to be arranged so that each has a good electrical connection.

Apart from electrical connection concerns, prior art self-contained receptacles can suffer from several other disadvantages. One common drawback pertains to the installation process. For example, the compact self-contained receptacle of Gesue, as disclosed in U.S. Pat. No. 7,394,019, comprises a cylindrical housing flush-mounted to a solid material wall or window sill. While the flush mounting can result in an aesthetically pleasing appearance, in many cases a user fails to achieve the desired look because receptacle installation requires a two-step hole to be drilled. A first diameter bore is to be formed to a shallow depth, then a second diameter bore, narrower than the first, must be made to a lower depth so that a cover plate can be seated in the counter sunk hole. Errors in drilling the larger hole can result in a cover plate that lies above or below the sill surface, rather than lying flush with the sill or wall. In addition to presenting a less attractive appearance, a cover plate seated below the surface can pose problems when an attempt is made to mate an electrical device with the receptacle. Furthermore, because the Gesue receptacle employs the insulation displacement connection method in which a cable must remain continuous when wired in a daisy-chain configuration a cable cannot be cut shorter to assist in pushing it back down the narrower hole, which can prove cumbersome or difficult for an installer.

Furthermore, prior art receptacles that use the insulation displacement method require a single cable to remain continuous throughout the circuit. These types of receptacles are often difficult or impossible to replace because the unbending and rebending of the cable during an attempted rewiring process can break the wires.

A further disadvantage of prior art receptacles is that in many cases they are configured for use with only non-metallic sheathed cable, and therefore cannot be used in applications in which metal-clad cable is used to provide power. Newer building code regulations that require the use of metal-clad cable can preclude the use of such receptacles, and therefore limit the wiring options available to the building user.

In addition, prior art devices often fail to provide features that can make the receptacle tamper-resistant. Consequently, they can pose potential hazards to consumers, and discourage those with young children from their use.

SUMMARY OF THE INVENTION

In an exemplary embodiment, a tamper-resistant self-contained receptacle (TRSCR) comprises a center base section configured for electrical connection with a first electrical cable, and a first door configured to couple to the center base and receive said first electrical cable. A TRSCR can further include a second door configured to couple to the center base and receive a second cable that can be connected to the center base. The center base section can include a curved seating portion configured to receive a cable wired to it.

In an example embodiment, a TRSCR is configured for electrical connection with a first cable by a first set of contacts, and configured for electrical connection with a second electrical cable by a second set of contacts. Two separate sets of contact screws can be used to connect two separate cables to a TRSCR. Providing a separate set of contacts for each cable facilitates quick and secure receptacle wiring with good electrical connections. In addition, a TRSCR can provide an extended ground clip to connect the metal sheath of a metal clad (MC) cable with a ground connection. A TRSCR can be wired with a MC cable or a non-metal sheath (NMS) cable, making it a versatile device that can be employed in diverse environments to satisfy both long-standing and more recently promulgated building code regulations. The doors of a TRSCR can be configured to provide strain relief for a cable received therein.

In an exemplary embodiment, a TRSCR can be configured to provide daisy-chain connectivity for MC cable, NMS cable, or both. For example, a first door can be configured to provide strain relief for a MC cable, and a second door can be configured to provide strain relief for a NMS cable, allowing the SCR to be used with either or both types of cable. In an example embodiment, a TRSCR includes a tamper-resistant cap having shuttered apertures for receiving the prongs of electrical plug. The shuttered apertures can prevent insertion of foreign objects into the receptacle.

In an example embodiment, a TRSCR provides a first ground contact for connection of a ground wire of a first cable and a second ground contact for connection of a ground wire of a second cable. Providing separate contacts for ground connections of separate cables improves electrical connectivity.

A TRSCR can be mounted in a variety of surfaces such as, but not limited to mantles, window sills, cabinets, backsplashes, and floors. In an example embodiment, a TRSCR assembly can include an accessory floor ring adapted to receive and secure the SCR in a floor. The floor ring can include a cover that protects the SCR from dirt, spilled fluids, or scrub water. An example TRSCR assembly can include an adapter collar configured to secure a TRSCR in a tile or concrete floor.

BRIEF DESCRIPTION OF THE SEVERAL DRAWINGS

DETAILED DESCRIPTION OF EXAMPLE EMBODIMENTS

As required, exemplary embodiments of the present invention are disclosed herein. These embodiments are meant to be examples of various ways of implementing the invention and it will be understood that the invention may be embodied in alternative forms. The figures are not to scale and some features may be exaggerated or minimized to show details of particular elements, while related elements may have been eliminated to prevent obscuring novel aspects. Therefore, specific structural and functional details disclosed herein are not to be interpreted as limiting, but merely as a basis for the claims and as a representative basis for teaching one skilled in the art to variously employ the present invention.

Figure 1:
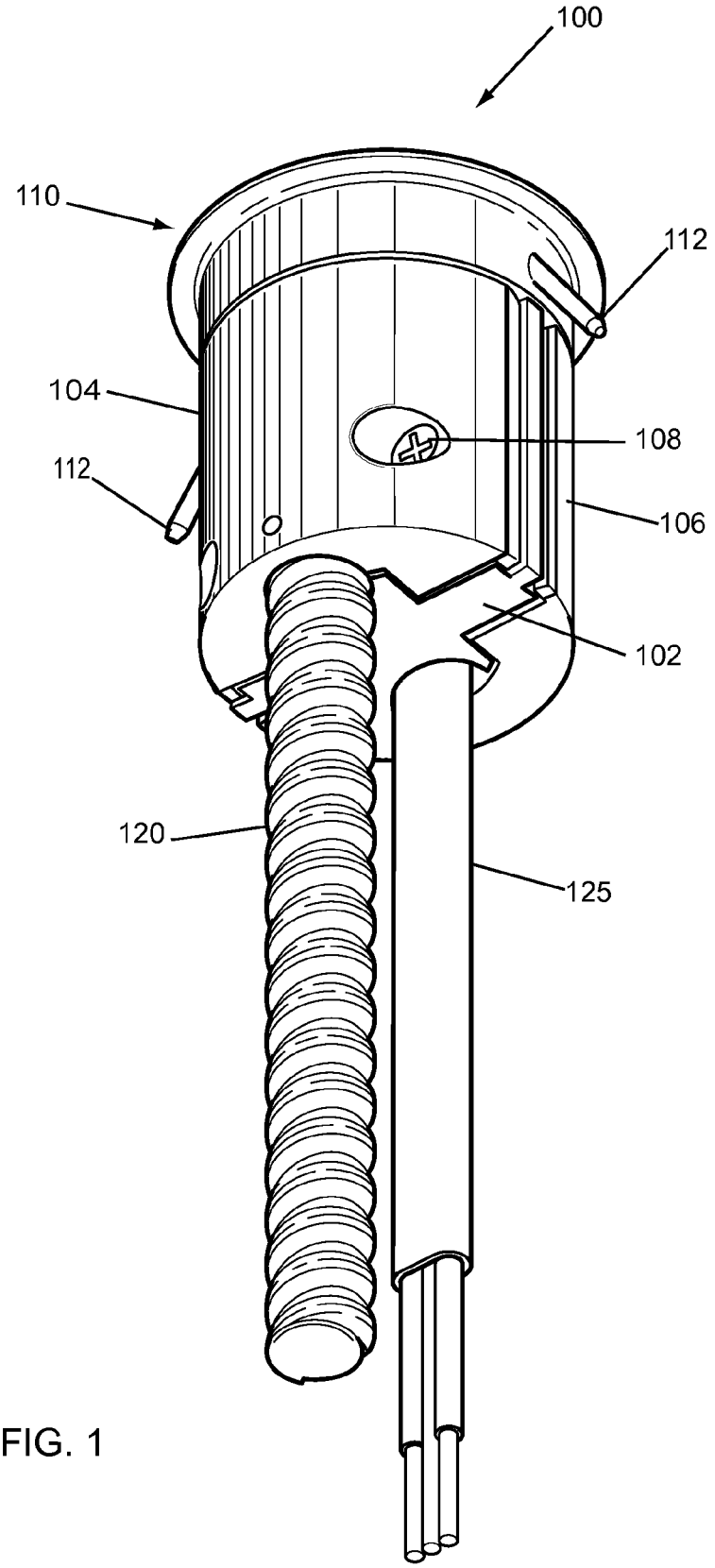
FIG. 1 shows a perspective view of an example embodiment of a tamper-resistant self-contained receptacle.

Turning now to the figures, wherein like numerals refer to like elements throughout the several views, FIG. 1 shows an example tamper-resistant self-contained receptacle (TRSCR) 100. The TRSCR 100 includes a center base section 102, a first door 104, and a second door 106. The first and second doors 104, 106 can be configured to couple to the center base 102 and provide strain relief for a first and second cable or wire, 120, 125 respectively. In an example embodiment, the first cable 120 is embodied as a metallic-clad (MC) cable, and the second cable 125 is embodied as a non-metallic sheath (NMS) cable. The first door 104 can be secured to the central base 102 via a door screw 108. A tamper-resistant cap 110 can be attached to the base 102 and provide a face for the TRSCR 100. The TRSCR 100 can be secured in its mounting environment via one or more mounting screws 112 that can be screwed through the cap 110 into the mounting surface.

As shown in FIG. 1, the TRSCR 100 can be configured to receive metallic cable or non-metallic cable, making the present TRSCR more versatile than prior art receptacles configured for only a single type of cable, and also enabling the present TRSCR to satisfy contemporary building code regulations that require metallic-clad wiring. Many prior art receptacles were either unable to receive MC wiring, were not equipped with a means to provide strain relief to a MC cable, or were incompatible with devices designed to provide MC cable strain relief.

Figure 2:
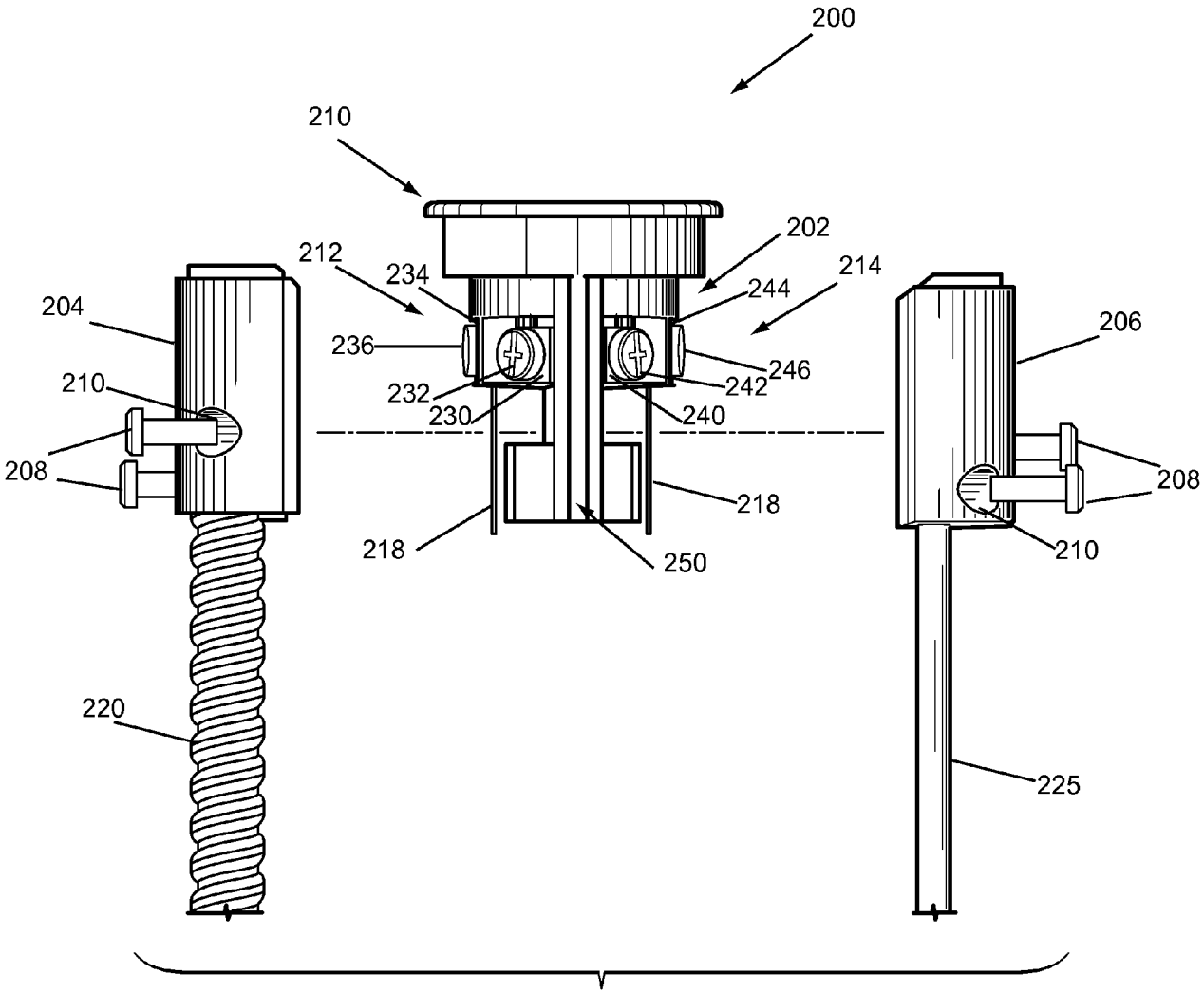
FIG. 2 shows a perspective view of the example embodiment of FIG. 1.

FIG. 2 shows an example TRSCR 200. The TRSCR 200 includes a center base 202, a MC cable door 204, a NMS cable door 206, and a tamper-resistant cap 210. The MC door 204 is configured to receive and provide strain relief for the MC cable 220. The NMS cable door 206 is configured to receive and provide strain relief for the NMS cable 225 Each of the doors 204, 206 can be secured to the base portion 202 by a pair of door screws 208 which can be inserted through door holes 210. In an exemplary embodiment, the door screws 208 are thread-cutting screws.

The TRSCR 200 includes a first set of contacts 212, for providing electrical connectivity for a first cable, for example MC cable 220, and a second set of contacts 214 for providing electrical connectivity for a second cable, for example NMS cable 225, which can be in the form of Romex® cable. Each of the first and second sets of contacts 212, 214 can include contact plates configured to receive contact screws, which in an exemplary embodiment are in the form of metal screws. For example, the first set of contacts 212 can include a first contact plate 230, and a first contact screw 232 for connecting a first wire, for example a hot wire of the cable 220 to the TRSCR 200. The first set of contacts 212 can further include a first ground plate 234 and a first ground screw 236 configured for connection with a ground wire of the MC cable 220.

The second set of contacts 214 can include a second contact plate 240, a second contact screw 242 for connection with a first wire, for example a hot wire, of NMS cable 225. The second set of contacts 214 can further include a second ground plate 244 and a second ground screw 246 for connection with a ground wire of the NMS cable 225. A base divider portion 250 can separate the first and second sets of contacts 212, 214. The contact plates 230 and 240 can be connected to provide electrical connectivity between like wires of the two cables 220, 225. For example the contact plates 230 and 240 can be in the form of a single contact plate that extends through the base divider 250, or be connected one to another by a conductive connection plate.

Thus, when used to connect two cables in a daisy chain arrangement, the TRSCR 200 can provide a separate contact screw for each wire of a cable, achieving improved electrical connectivity over that of prior art receptacles that provide but a single screw for two like wires of separate cables. In addition to improved connectivity, the separate sets 212, 214 of contacts for connection with separate cables facilitate and quicken TRSCR wiring by a technician. A wire can be curved to loop around a shaft of a terminal screw, eliminating the need for an additional "C"-shaped component to keep multiple wires underneath a single screw head when a terminal screw is tightened, as required by some prior art devices. Furthermore, when a contact screw is used to connect multiple wires, it is subject to greater stress than when used to connect only a single wire, increasing the likelihood that it will strip out. The present invention avoids subjecting contact screws to that increased stress, improving the longevity and performance of a TRSCR.

In addition, because the TRSCR 200 provides terminal screws around which a wire of a cable is looped to make contact, rewiring of the TRSCR 200 can be performed easily and safely without imposing a high risk of damaging the wires. Prior art receptacles often employed an insulation displacement connection method in which the outer sheath of a cable is punctured in order to connect the receptacle to inner wires of a cable, which had to remain continuous when wired in a daisy-chain in-and-out arrangement. In many prior art devices, if a looped cable was cut in two sections, only one section could be connected. Rewiring of receptacles wired by the insulation displacement method often results in breaking one or more inner wires and rendering a portion of cable useless. In addition, some prior art receptacles are configured to receive only a single ground wire, rather than two, so if a ground wire was cut, only a single section of cable could be connected to the receptacle.

An extended ground clip 218 can extend from each ground contact plate 234, 244 to provide additional ground connectivity for a MC cable. In an example embodiment, the ground clip 218 can be arranged to contact the metal jacket of an MC cable to connect the metal jacket with the ground path of the electrical circuit. When an NMS cable is connected to the set of contacts 212 or 214, the ground clip 218 can be cut off in the field prior to connecting the NMS cable.

Figure 3:
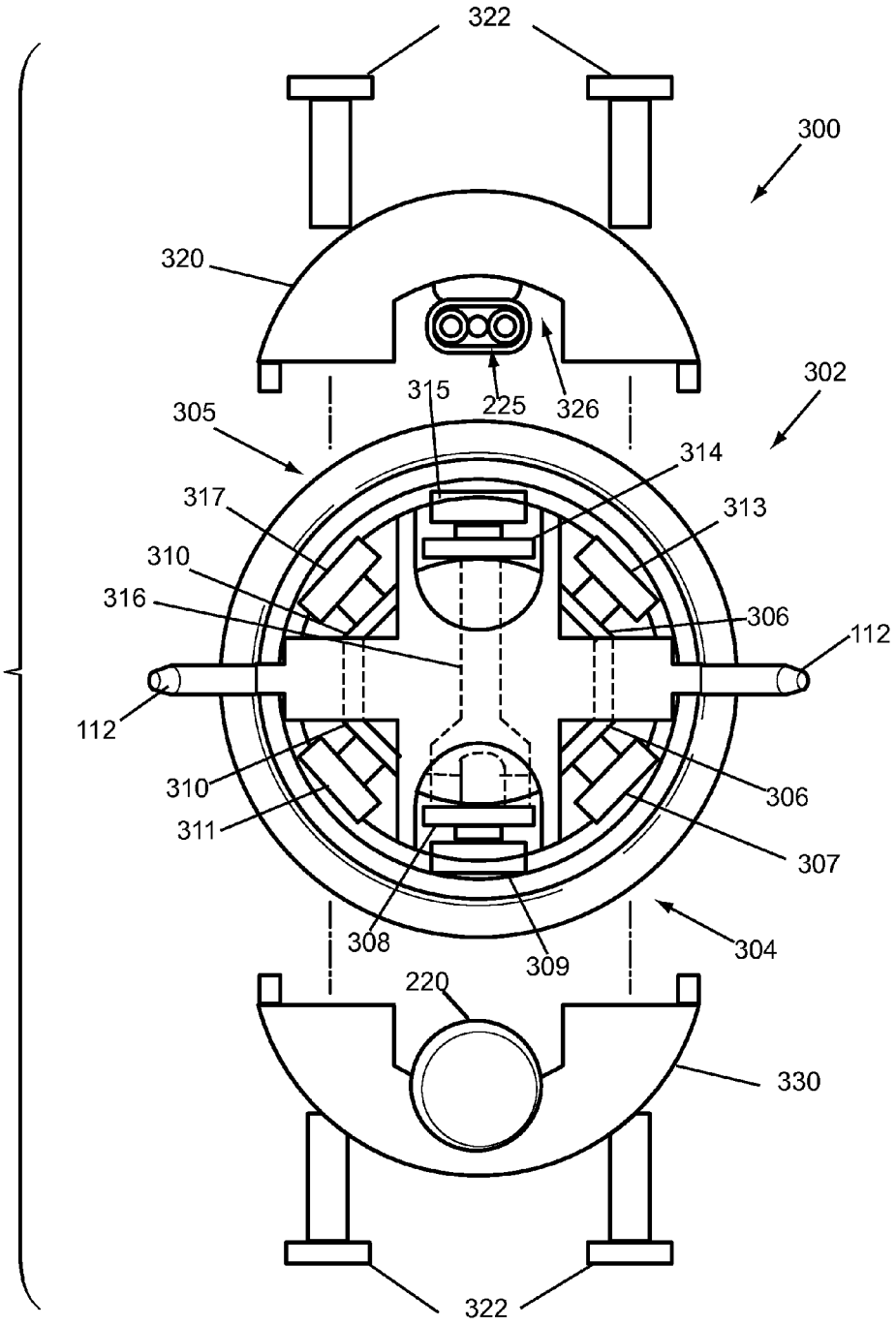
FIG. 3 shows a plan view of the example embodiment of FIG. 2, looking up from the bottom of the self-contained receptacle.

FIG. 3 depicts an example TRSCR 300 having a center base portion 302 with a first set of contacts 304 and a second set of contacts 305. The first set of contacts 304 can include a first contact plate 306 with a first contact screw 307, a ground plate 308 with a ground screw 309, and a second contact plate 310 with a second contact screw 311. In an exemplary embodiment, screws 307, 311 are metal screws configured to provide electrical connection for a hot or neutral wire of a cable.

The second set of contacts 305 can include the first contact plate 306 with a first contact screw 313, a ground contact plate 314 with a ground contact screw 315, and the second contact plate 310 with a second contact screw 317. The first contact plate 306 is configured to receive the contact screw 307 and the contact screw 313 so that like wires of separate cables can be electrically connected for current flow. For example, a hot wire of the MC cable 220 can be connected to the contact screw 307 and a hot wire of a the NMS cable 225 can be connected to the contact screw 313 with the first connection plate 306 providing connectivity therebetween. Similarly, a neutral wire of the MC cable 220 can be connected to the contact screw 311 and a neutral wire of the NMS cable 225 can be connected to the contact screw 317, with the second connection plate 310 providing electrical connectivity therebetween. In an example embodiment the ground plates 308 and 314 can be connected by a ground connection plate 316 to provide ground connectivity between two separate cables. Connection of separate ground contacts for separate cables provides improved electrical connectivity over that offered by prior art devices which either fail to provide separate ground contacts for separate cables, or fail to provide connections between separate ground contacts. As mentioned previously herein, an example embodiment can include two separate contact plates connected by a conductive connection plate in order to provide electrical connectivity between like wires of separate cables.

FIG. 3 shows a first door 320 and a second door 330. The first door 320 is configured as a NMS door that can provide strain relief to a NMS cable and attach to the center base portion 302 via a pair of door screws 322. The NMS cable 225 can be positioned in a curved cable recess 326 and be secured by a tab 328 configured to clamp down on and provide strain relief to the NMS cable 225 when the first door 320 is secured to the base portion 302. The second door 330 is a MC door configured and to receive a portion of the MC cable 220 in a screw-shaped cavity that can provide strain relief for the MC cable 220. The door 330 is configured to attach to the center base portion 302 via a pair of door screws 322. In addition to providing strain relief for a cable, the first and second doors 320, 330 cover and protect the two sets of contacts 304, 305.

Figure 4:
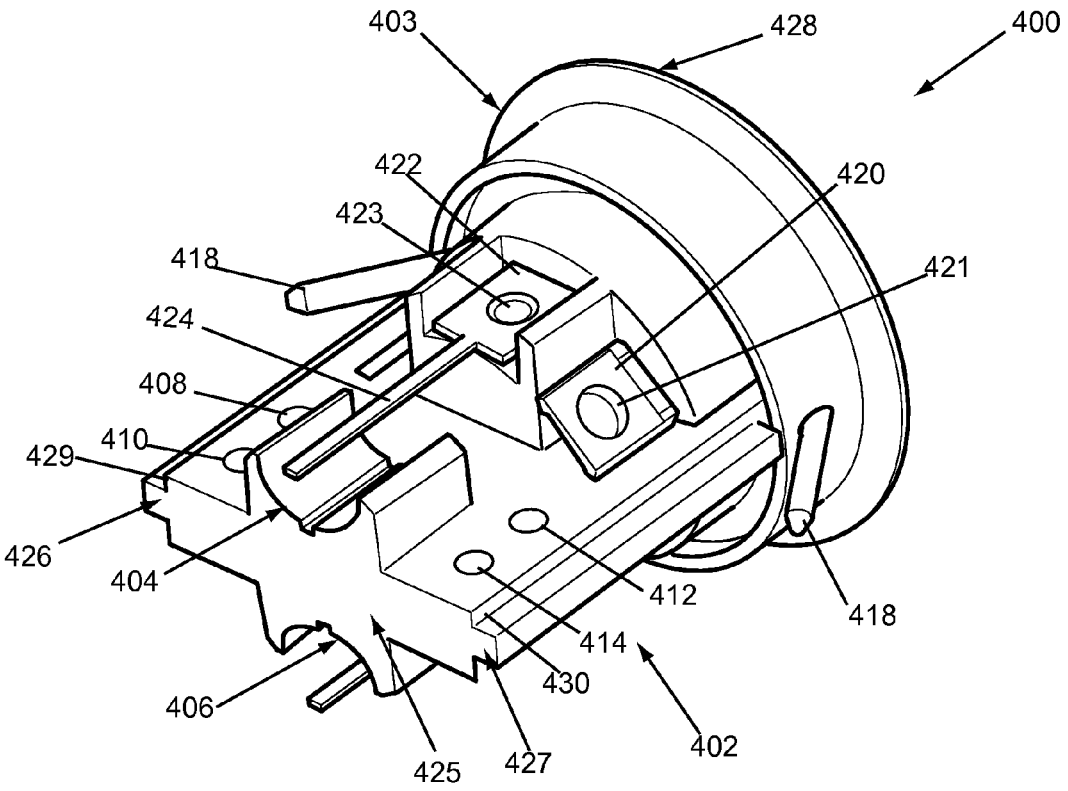
FIG. 4 shows a perspective view of an example tamper-resistant self-contained receptacle.

FIG. 4 shows an example TRSCR 400 comprising a center base section 402 with a cap 403. The center base 402 comprises a first curved seat 404 for receiving a portion of a first cable, and a second curved seat 406 for receiving a portion of a second cable. In an example embodiment, the base 402 comprises a non-conducting material such as a plastic to serve as a support and divider for metallic contacts. The base 402 can be configured with a first upper hole 408, a first lower hole 410, a second upper hole 412 and a second lower hole 414, each configured to receive a door screw such as door screw 322, so that a first and a second door can be coupled to it.

Further provided at the base portion 402 is a contact plate 420 with an aperture 421 for receiving a contact screw. A ground contact plate 422 with an aperture 423 configured to receive a ground contact screw is also disposed at the base portion 402. As shown in FIG. 4, the ground contact plate 422 includes an extended ground clip 424, which, as mentioned previously herein, can be used to connect the metal sheath of a MC cable with the ground contact of a circuit, an advantageous feature prior art receptacles can fail to provide. A pair of mounting screws 418 can be used to secure the TRSCR 400 to a platform in which it is mounted. In an exemplary embodiment the mounting screws 418 can be embodied as wood screws. As shown in FIG. 4, the mounting screws can extend through the cap 403 into the platform into which an TRSCR is mounted, such as a window sill or mantle. A flange 428 extending outward from the cap 403 can rest on top of the platform to support the TRSCR 400 and hold it level on the platform until the mounting screws 418 are secured to the platform. A base divider 425 can separate the base 402 into a first portion configured to receive a first cable and first door and a second portion configured to receive a second cable and a second door. The base divider 425 can further provide a first ledge 426 and a second ledge 427 for abutting doors that are coupled to it.

Figure 5B:
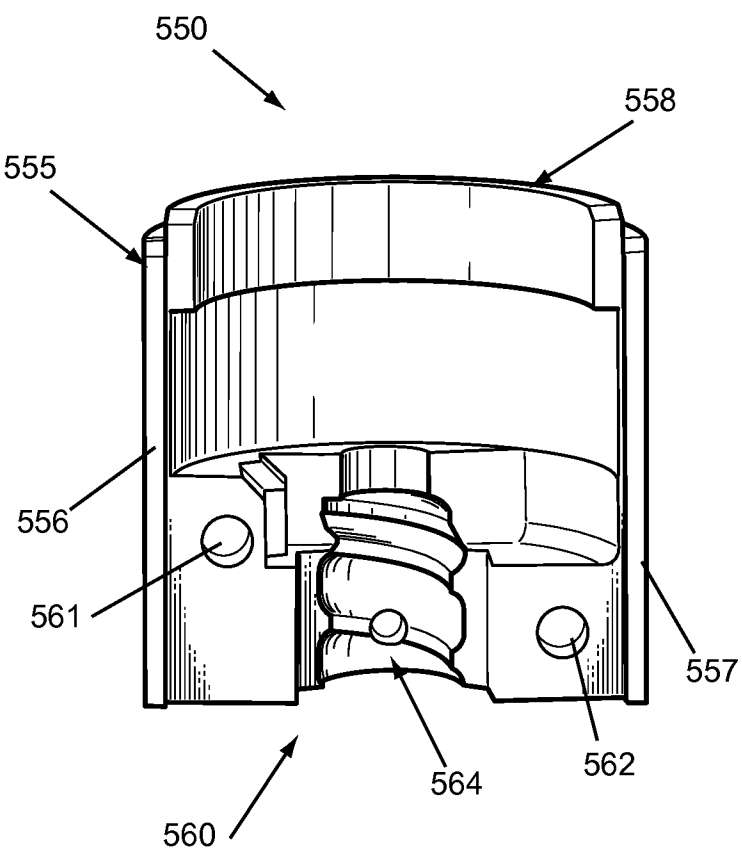
FIG. 5B shows a perspective view of example doors of a tamper-resistant self-contained receptacle.
Figure 5A:
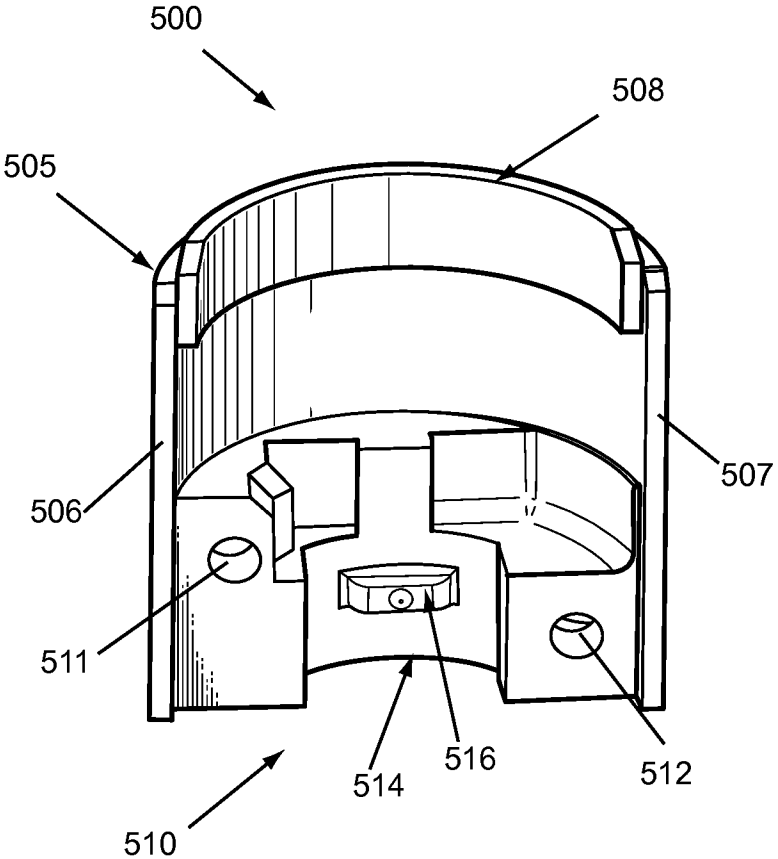
FIG. 5A shows a perspective view of example doors of a tamper-resistant self-contained receptacle.

FIGS. 5A and 5B show an example NM cable door 500 and example MC cable door 550 that can be coupled to either side of a base of an exemplary TRSCR. The example NM cable door 500 is configured to couple to a TRSCR center base and provide strain relief for a NMS cable. The NM cable door 500 comprises a curved wall 505 with a first end wall 506 and a second end wall 507. In an example embodiment, the first and second end walls 506, 507 are configured to abut a TRSCR base at its first and second divider ledges 426, 427. The cable door 500 can further include an upper lip 508 configured to be engaged by a catch in an TRSCR base section, for example a catch can be located above a set of contacts to prevent the door 500 from bowing out when door screws are screwed in to couple the door 500 to a center base portion. The NM cable door 500 further can further include an inner portion 510 which can include an upper screw hole 511 and a lower screw hole 512 each configured to receive a door screw configured to couple the door 500 to an TRSCR center body. A curved cable recess 514 in the inner portion 510 can be configured to receive a NM cable, such as Romex® cable. A tab 516 can be disposed in the cable recess 514 to push against a NM cable received therein so as to provide cable strain relief. In an example embodiment, to accommodate either 12 gauge or 14 gauge NMS cable, the walls 506 and 507 can overlap with the vertical edges 429, next to ledge 426, and 430, next to ledge 427, to maintain a seam between the walls 506 and 507 and the adjacent base divider 425, to provide a gap of less than 0.010" once the door screws 322 are secured to the base 402.

Referring to FIG. 5B, the example MC cable door 550 can be configured to couple to a TRSCR center base and provide strain relief for a MC cable. The MC cable door 550 can comprise a curved wall 555 having a first end wall 556 and a second end wall 557. In an example embodiment, the first and second end walls 556, 557 are configured to abut an TRSCR center body at its divider ledges. The cable door 550 can further include an upper lip 558 configured to be engaged by a catch in an TRSCR base, to prevent the door 550 from bowing out when door screws are screwed in to couple the door 550 to a TRSCR center base. The MC cable door 550 can further include an inner portion 560 that can include an upper screw hole 561 and a lower screw hole 562, each configured to receive a door screw to couple the door 550 to a TRSCR base. Inner portion 560 can further include a screw-shaped cavity 564 configured to receive a MC cable. The screw-shaped cavity 564 can provide strain relief to an MC cable without crushing the outer metal jacket of the cable when the door 550 is secured to a base portion by one or more door screws.

A TRSCR can be used in an arrangement in which a single cable is wired to it to power an end-of-line device, and can also be used in a daisy chain arrangement in which power is provided to the TRSCR by a first cable and then delivered to another load down the line by a second cable. When used in a daisy-chain arrangement, two MC cables can be wired to the TRSCR, two NMS cables, or one MC and one NMS cable can be wired to the TRSCR, using the appropriate door for each cable. In a further example embodiment, a universal TRSCR door can comprise a screw-shaped cavity with a break-away tab, for example a tab similar to the tab 516 that is disposed in the door 500. In such an embodiment, the break-away tab can be left intact to provide strain relief to a NMS cable received in the screw-shaped cavity, but can be detached when the universal door is used with MC cable, allowing the screw-shaped cavity to provide strain relief to the MC cable. As shown in FIGS. 2-5, a TRSCR can provide a unique entry point and unique strain relief for each of two separate cables wired to it to better secure and protect the cables and their connections.

Figure 6:
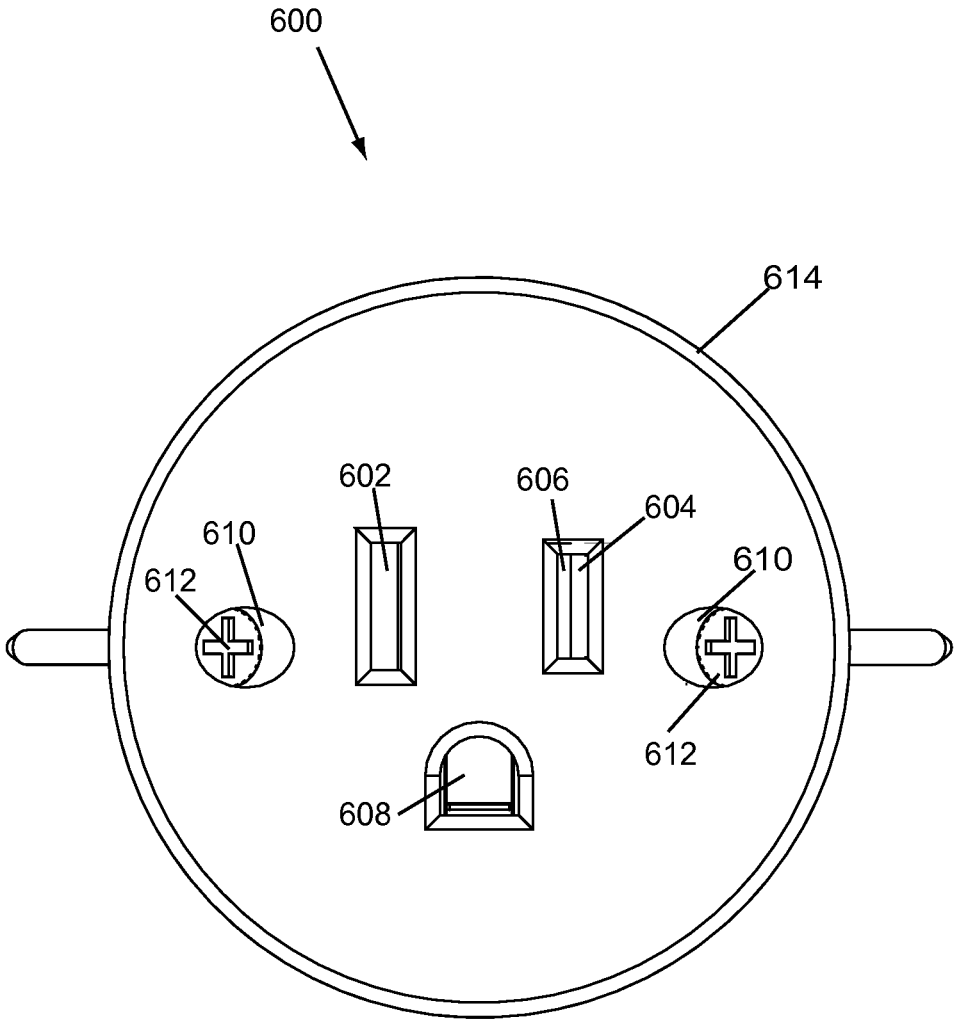
FIG. 6 shows a plan view of the example embodiment of FIG. 1, looking down at the top.

FIG. 6 shows a planar view an example cap 600 for a TRSCR. In an example embodiment, the cap 600 is tamper-resistant and configured with a first shutter 602 configured to cover a first aperture for receiving a first prong of an electrical cord plug, and a second shutter 604 configured to cover a second aperture 606 configured to receive a second prong of an electrical plug. The cap 600 can further include a ground aperture for receiving a ground prong of an electrical plug. Thus, both the hot and neutral prong apertures can be covered with a shutter to provided resistance to tampering. The shutters 602 and 604, can remain completely closed when no device is plugged into a TRSCR, and can be opened to receive both the hot and neutral plug prongs from either a two prong or three prong plug. The shutters 602, 604 offer protection against insertion of foreign objects or fingers, a safety feature often required in contemporary building code regulations, and particularly advantageous when the TRSCR is mounted in a window sill or other surface accessible to young children. When a plug prong is inserted into the first or second apertures, the first and second shutters 602, 604 can partially close to cover any gap between the inserted prong and an edge of the aperture. The cap 600 can include a first and second screw hole 608 configured to receive a mounting screw 612. By way of example, but not limitation, the mounting screw 612 can be embodied as a wood screw configured to extend through the cover 600 and into a platform in which a TRSCR is mounted. The cap 600 can be configured with an upper flange 614 which can support a TRSCR over a hole during a mounting process. In an exemplary embodiment the cap 600 can be configured to receive a polarized plug.

Figure 7:
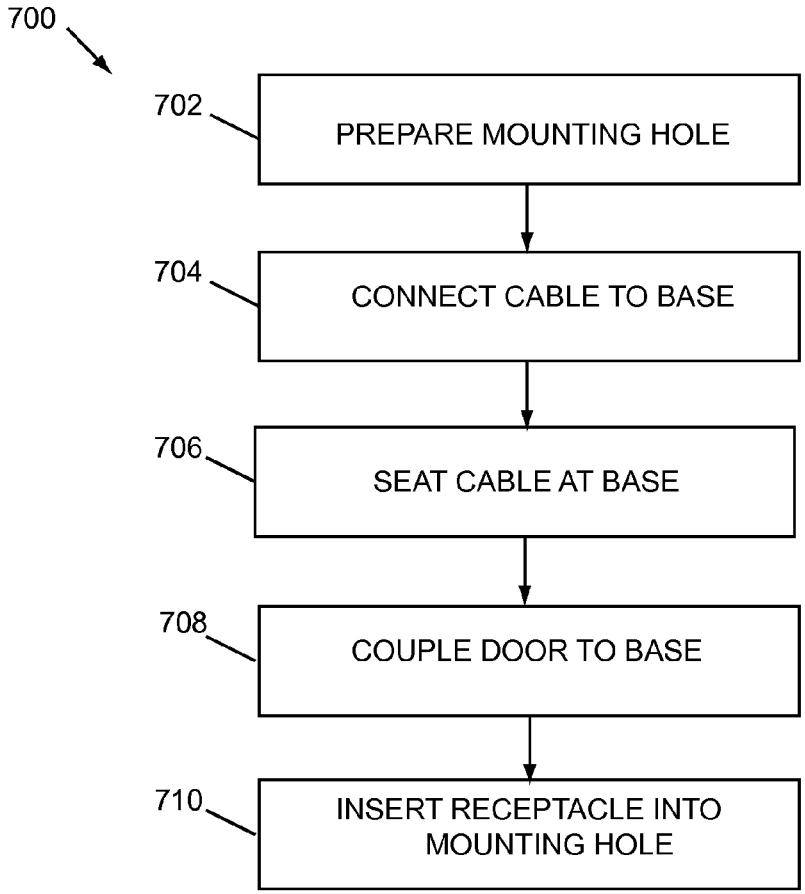
FIG. 7 shows an example method 700 for using a tamper-resistant self-contained receptacle.

Because the TRSCR is a self-contained receptacle, there is no need for an additional junction box, making it an attractive candidate for mounting in a mantel, cabinet, window sill, floor or other wood surfaces. Wiring and mounting of a TRSCR is relatively simple and quick compared to the installation of some prior art receptacles. FIG. 7 shows an example method 700 of installing a TRSCR. At block 702, a hole can be prepared for receiving a TRSCR. In an exemplary embodiment, a TRSCR has a height of around 2⅛" and can be dropped into a 1¾" diameter hole prepared in a mounting surface. As stated earlier, a single bore hole is adequate, avoiding the need for, and risks associated with, drilling a two-step hole. The relatively small size of a TRSCR can compare favorably to prior art receptacles that require a larger and deeper hole. For example, a typical drop-in floor receptacle can have a height of around 7" and can require a wiring volume of around two cubic inches per conductor when wiring nuts are used for the connections. The shallow depth that a TRSCR protrudes below the mounting surface allows it to be mounted in a smaller hole and minimizes the likelihood that a pipe or other obstacle in a floor cavity will interfere with it.

At block 704, a user can wire a TRSCR. An example TRSCR, such as the TRSCR 100, can be wired in an end-of-run configuration or in a daisy-chain configuration. Because a TRSCR uses terminal screws for connections, it can be used with two separate sections of cable, rather than a continuous un-cut cable that prior art receptacles wired via the insulation displacement method needed in order to be wired in a daisy-chain configuration. In an example embodiment, a TRSCR can be wired with one or two sections of 12/2 or 14/2 gauge wire. Furthermore, a TRSCR can be wired with NMS cable or MC cable. Many prior art receptacles were configured for one type of cable to the exclusion of the other.

Figure 8:
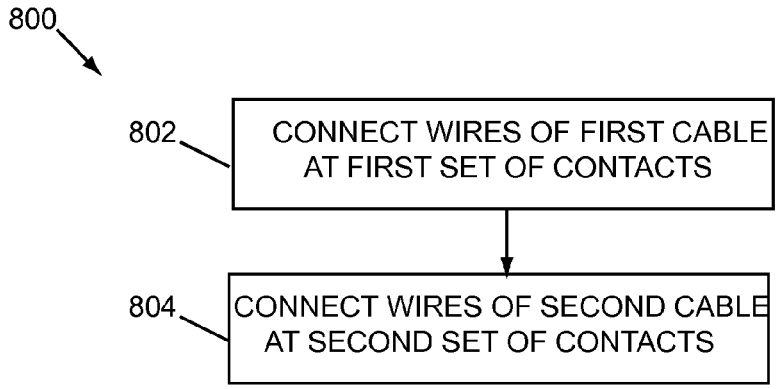
FIG. 8 shows an example method 800 for using a tamper-resistant self-contained receptacle.

FIG. 8 shows an example method 800 for wiring the TRSCR 100 in a daisy chain configuration using both MC cable and NMS cable. At block 802, wires of a first cable can be connected. For example, a cable that can deliver power to a TRSCR from a circuit power source can be pulled up through the prepared hole. In an example method, the first cable can be MC cable 220. The inner wires of the MC cable 220 can be connected to the SCR base 302 at the first set of contacts 304. If a TRSCR is packaged with one or two doors, for example doors 104 and 106, attached to the center base section 102, the doors can be detached by removing all door screws 112 so that both sets of contacts 304, 306 are exposed. By way of example, but not limitation, the metal sheath of the MC cable 220 can be stripped to leave about 1¼" of wire exposed. The hot (typically black) and neutral (typically white) wires can then be stripped around ½", and curled with small pliers to wrap around contact screws 307 and 311 respectively, which can be tightened to ensure proper contact. The extended ground clip 424 can be depressed into the curved seat 406 to rest against the metal sheath of the MC cable 220 when it is received at the base 302. The ground wire (typically plain copper or green) can be wrapped around the ground contact screw 309 to provide a ground connection. In an example embodiment, a nylon bushing can be inserted around the wires.

At block 804, wires of a second cable can be connected to the SCR 100. For example, a NMS cable 110, such as Romex® cable, can be connected to the SCR 100 to deliver power to a device down the line in the circuit. The NM sheath can be stripped to leave about 1¼" of wire exposed for connection with the second set of contacts 306. The hot wire can be wound around the contact screw 313, the neutral wire around contact screw 317 and the ground wire around the ground screw 315. Since the NMS cable 110 has no outer metal covering, there is no need for the ground clip 218, which can be cut off below the ground contact plate 314 and folded down.

A TRSCR can be wired in a daisy chain configuration without bending the wires beyond a radius considered acceptable by the national electric code (NEC). Furthermore, if a TRSCR needs to be replaced, the wires can be cut and re-stripped for easy installation at a replacement receptacle. Unlike prior art receptacles, replacing a receptacle does not require that wires be bent in a manner that is likely to break them.

Referring back to FIG. 7, at block 706 a cable can be seated in a TRSCR. For example, the MC cable 220 can be pushed into curved seat 404 in contact with the ground clip 424. The NM cable 225 can be pushed into curved seat 406, and ground clip 427 can be cut off.

At block 708 a door can be attached to the center base of a TRSCR. An appropriately configured door for receiving a particular type of cable can be selected. For example, to cover the MC cable 220 connections at the first set of terminal screws 304, the MC door 550 can be selected. The MC door 550 can be positioned at the cable base 202 so that the upper lip portion 558 fits under the cap rim 432, the endwalls 556, 557 abut the divider ledges 425, 426 and the screw-shaped cavity 564 can receive the MC cable 220 connected at the first set of contacts 304, with the ground clip 424 in contact with the metal jacket of the MC cable 220. The screw-shaped cavity 564 can provide strain relief for the MC cable 220. A pair of door screws 208 can be used to attach the door 550 to the center base 204. By way of example, but not limitation, a first door screw 208 can be inserted in upper hole 561, and screwed into first upper hole 408 to couple the door 550 to the center base 402. Similarly, a second door screw 208 can be inserted in lower hole 562 and screwed into second lower hole 414 to couple to the center base 402.

The NM door 500 can be selected to cover the NMS cable 225. The NM door 500 can be positioned at the base 402 so that the upper lip 508 fits under the cap 403, and the curved recess 514 can receive the NMS cable 225 connected at the second set of contacts 306. A pair of door screws 208 can be used to attach the door 500 to the base 402. By way of example, but not limitation, a first door screw 208 can be screwed into upper hole 511, and through hole 412 to couple the door 500 to the center base section 402. Similarly, a second door screw 208 can be inserted in lower hole 512 and screwed into hole 410 to couple the NM door 500 to the center base section 402. The tab 516 can provide strain relief for the NMS cable 225.

In an example embodiment, contact screws used to connect hot and neutral wires of two cables can extend further toward the bottom of a TRSCR than does a center screw used as a ground contact screw. This positioning can shorten the distance from the hot and neutral contact screws to a wire's entry point in the bottom of the base 402, and can eliminate the need to shorten a ground wire for a quicker installation process.

In a further embodiment, in which a universal door with a screw-shaped cavity and a break away tab is employed, the break-away tab can be detached when the universal door is used to cover a MC cable, and retained when used to cover a NMS cable so that appropriate strain relief can be provided. The universal door can then be attached in the manner described above. Because the doors can be installed after the cable wires are connected to the TRSCR contact screws there is no need to remember to insert wires into a particular portion of a receptacle prior to connecting them to contact screws. Furthermore, less wire needs to be pulled up through a mounting surface when connecting to a TRSCR in comparison to connecting to prior art devices. The less wire that is pulled up, the less wire that must be pushed back down into the cavity below the mounting surface, the quicker the installation can be performed, and the less risk of damage to the wires.

Thus each cable wired to a TRSCR has a unique entry point and its own strain relief. It is noted that when deployed in an end-of-line configuration with only a single cable attached, a MC door, a NMS door, or a universal door can be attached to a center base to cover, protect and block access to unused terminals.

At block 710, a wired TRSCR can be inserted into the prepared hole. In an exemplary embodiment, the one or two cables wired to a TRSCR can be pushed down into its cavity prior to insertion of a TRSCR. The upper flange 430 of the cap 403 can rest on the mounting surface to support a TRSCR in its hole while the mounting screws 418 are inserted through holes 608, 610 in the cap 610 and screwed into the solid material in which the TRSCR is mounted. In an exemplary embodiment, a cover cap (not shown) can be inserted to cover the cap 610. The cover cap can prevent contaminant entry when the TRSCR is not in use. The cover cap can be finished to match the surface in which the receptacle is mounted to obtain a desired coordinated appearance.

Figure 9A:
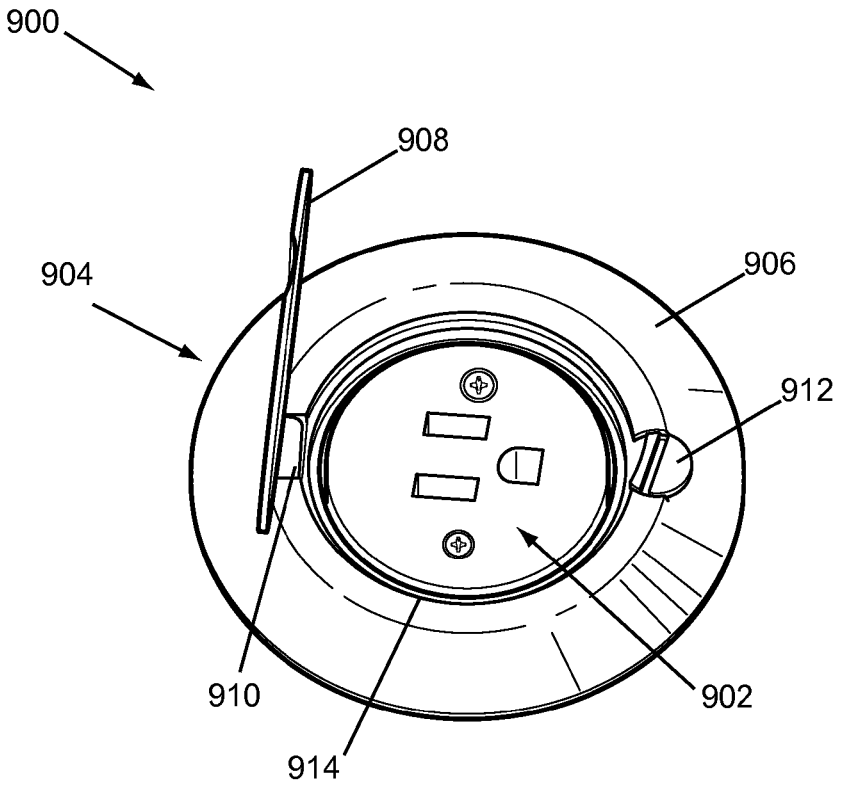
FIG. 9A shows an example tamper-resistant self-contained receptacle assembly with floor ring accessory for floor mounting.
Figure 9B:
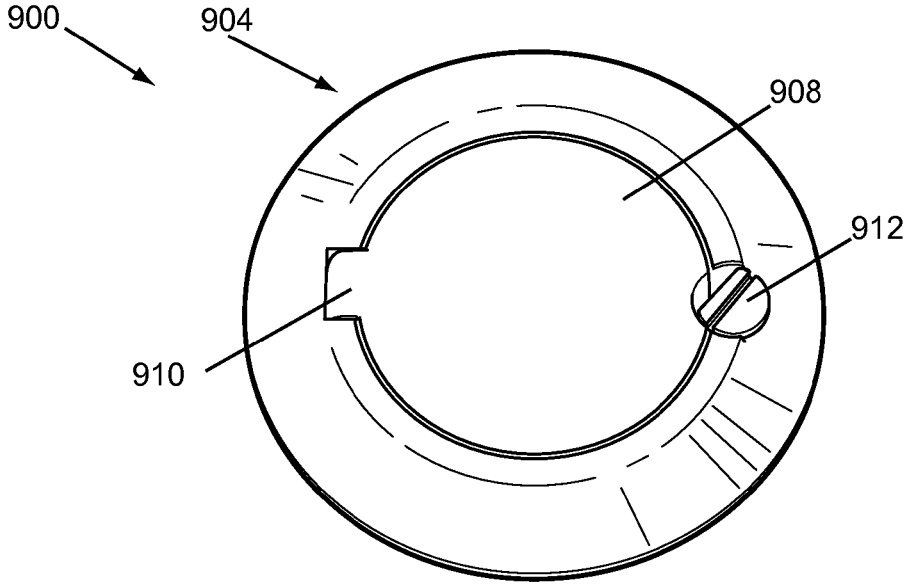
FIG. 9B shows an example tamper-resistant self-contained receptacle assembly with floor ring for floor mounting.

In an exemplary embodiment, an accessory floor ring can be used in the installation of a TRSCR in a wood, carpeted or tiled floor. As shown in FIGS. 9A, 9B, an SCR assembly 900 can include a TRSCR 902 and an example floor ring 904. The floor ring 904 can include a body portion 906, a cover 908 connected to the body portion 906 by a hinge 910, and a latch 912. The inside diameter of the body portion 906 can include a small flange 914 that an upper flange 430 of a TRSCR cap 403 can rest on. When a TRSCR is secured to the floor, the mounting screws inserted in screw holes in a TRSCR cap can extend through the to secure it to the floor or sub-floor with the upper flange 430 of the TRSCR securing the the floor ring 904 by holding down the small flange 914. The cover 908, which can be hinged to prevent it from being misplaced when the receptacle is in use, conceals the TRSCR 902, protecting it from debris and tampering. When closed, the cover 908 can also prevent the entry of scrub water, satisfying standard requirements for a floor rated receptacle in UL 514C. A latch 912 can be used to lock the cover 908 in a closed position.

The body portion 906 can form an extended flange around the TRSCR 902 to hold down the carpet underneath it, or conceal an inexact hole cut in a wood or tile floor covering, to provide a finished appearance. The floor ring 904 can extend an upper flange of a TRSCR cap and taper down to the floor to: (1) provide a shallow ramp to minimize the trip hazard after a TRSCR is installed; (2) provide a cavity in which caulk can be applied to seal the floor ring against a solid surface floor; and (3) hold down the carpet under the flange in a carpeted floor. Since a TRSCR and an accessory floor ring do not require an additional enclosure, the two-piece assembly can provide a floor receptacle smaller than those observed in the prior art. It is contemplated that in a further embodiment, rather than being configured as a separate accessory for a TRSCR, a floor ring can be made an integral part of a TRSCR specifically configured for floor installation.

In a further embodiment, a floor ring can have a cover that is completely removable and configured to couple to a floor ring via male threads along the cover's outside diameter which are configured to mate with female threads disposed around the inside diameter of a floor ring.

In an exemplary embodiment, a TRSCR and a floor ring can be provided in a variety of finishes and colors. By way of example, but not limitation, a floor ring can be provided in a brass, bronze or nickel finish. A TRSCR can be configured in various colors, including, but not limited to, black, white, or brown.

In those applications in which a TRSCR is to be installed into a concrete or stone surface, such as, but not limited to, a poured concrete slab or granite backsplash, a TRSCR can be physically attached to a hole in the concrete or stone surface by an epoxy or other adhesive material. However, since many electric code regulations require a receptacle to be secured by a mechanical means to allow device removal for servicing, an adapter collar can be pre-installed in the slab or stone to create a properly-dimensioned cavity for receiving a TRSCR; and further to provide a surface to which mounting screws can attach to secure the TRSCR while allowing it to be easily removed for inspection or replacement.

Figure 10A:
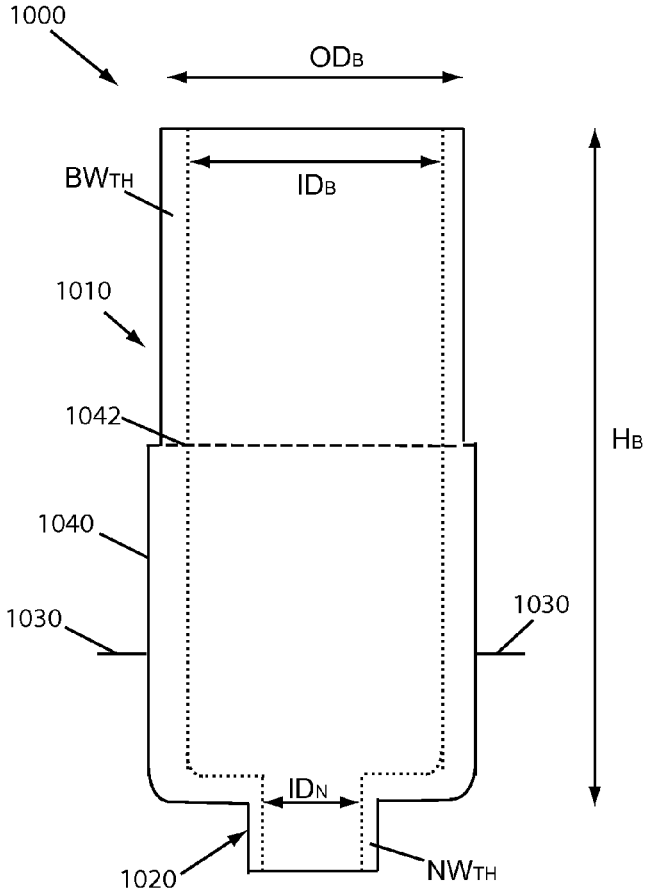
FIG. 10A shows an accessory collar for a tamper-resistant self-contained receptacle that can be used for mounting in concrete.
Figure 10B:
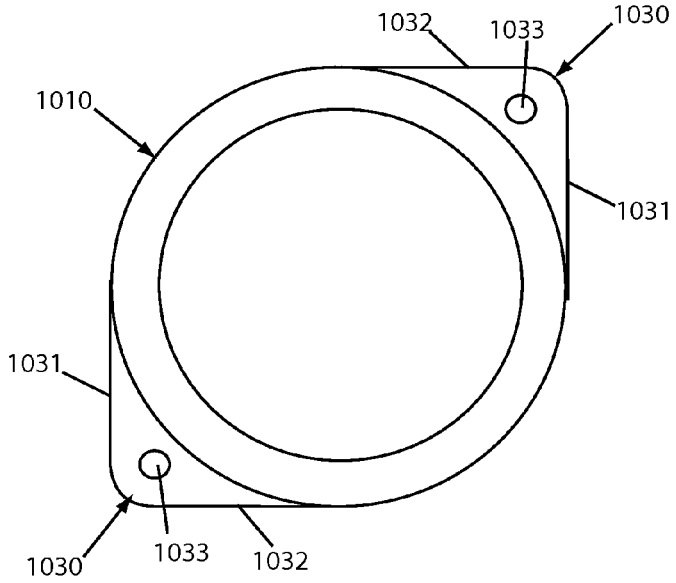
FIG. 10B shows an accessory collar for a tamper-resistant self-contained receptacle that can be used for mounting in concrete.

FIGS. 10A, 10B show an example adapter collar 1000 having a body portion 1010 and a nipple portion 1020. The adapter collar 1000 allows a TRSCR to be mounted into concrete or stone surfaces in the same manner as it would be mounted to a wood surface. A hole can be prepared, the adapter collar inserted, and a TRSCR coupled to the adapter collar 1000 via mounting screws. In an exemplary embodiment, the body portion 1010 has an overall height $H_B$ of 7", an interior diameter ($ID_B$) of at least 1.750", and an outer diameter ($OD_B$) of at least 2.250", providing a wall thickness $BW_{TH}$ of at least 0.230" for insertion of TRSCR mounting screws. In an example embodiment, the nipple portion 1020 has a height $h_n$ of 1", and a diameter that matches the diameter of ¾" PVC so that it can be inserted into a bell end of a portion of ¾" PVC tubing, or mate with a PVC coupler ring, enabling the collar 1000 to mate with standard trade conduit. In an illustrative example, the nipple portion 1020 has an outer diameter ($OD_N$) of 1.05" and an inner diameter ($ID_N$) of 0.824", providing a nipple wall thickness $NW_{TH}$ of 0.113".

A top portion of an adapter collar 1000 can be cut to become a shortened collar section of a single diameter which can then be glued, epoxied, or otherwise fixed within a hole of a larger diameter drilled into a solid surface, such as, but not limited to, a countertop backsplash made of granite. In an example embodiment, the adapter collar body portion 1010 can include an outer ridge 1040 that extends along its lower portion from its bottom, where the nipple portion 1020 begins, up to a ridge line 1042. Preferably, the tops of the anchor protrusions 1030 can be disposed 1.2" below the ridge line 1042 to secure the adapter collar behind granite.

The body portion 1010 can be configured with one or more anchor protrusions 1030. The anchor protrusions 1030 can be triangular shaped, with the sides 1031 and 1032 perpendicular to one another. The anchor protrusions 1030 can form a 90° corner on one or more places on the adapter collar body 1010 to allow it to rest on a flat surface without rolling, so that it can be cut to a desired length at a construction site. Example anchor protrusions 1030 can have rounded corners and diameters that lessen the likelihood that they will tear the adapter collar packaging.

In an example embodiment, the anchor protrusions 1030 can be configured with a hole 1033 to allow the adapter collar 1000 to be secured while a concrete slab is being poured. The anchor protrusions 1030 can extend outward from the body 1010 into the poured concrete so that the adapter collar is rigidly secured when the concrete hardens. In an illustrative example, the anchor protrusions are 0.070" thick with a 0.030" radius top and bottom where they transition into the adapter collar body, and the hole 1033 has a diameter of 0.200".

The body portion 1010 can have a height $H_B$ of around 7" to extend above the finished grade of a poured concrete slab. Once the slab has hardened, the adapter collar 1000 can be cut down to be flush with the finished floor. The adapter collar 1000 can mate to a piece of standard trade conduit at its nipple portion 1020, and widen to an $ID_B$ that is about the same as an outer diameter of a TRSCR center base. After the adapter collar 1000 is installed in the concrete slab, a TRSCR base can be inserted into the adapter collar 1000 and secured thereto. In an exemplary embodiment, the adapter collar 1000 is made of plastic so the same mounting screws configured to secure a TRSCR into a wood surface can be used to secure a TRSCR to the adapter collar 1000.

Thus, a TRSCR can provide a self-contained receptacle that can be wired with two separate cables in a daisy-chain arrangement, facilitating both its installation, performance and replacement. A TRSCR can be coupled to two MC cables, two NMS cables, or a MC cable and a NMS cable, providing a tamper-resistant receptacle with exceptional versatility. In addition, a TRSCR can provide a separate set of contacts for each cable for improved electrical connectivity over devices that couple like wires at a single contact. The separate set of contacts can include two separate ground contacts for connecting two ground wires of separate cables. Ground contact plates can be configured with an extended ground clip that can be coupled to the outer sheath of a MC cable for improved ground connectivity. In addition to its own set of contacts, each cable is provided a separate point of entry to a TRSCR, and is further provided its own strain relief. For installations in flooring, concrete or stone surfaces, a TRSCR can be used with an accessory such as a floor ring or an adapter collar. A TRSCR installation can require only a single bore to be drilled in a mounting, a distinct advantage over the installation of receptacles that require two or more holes of different diameters must be drilled.

As required, exemplary embodiments of a TRSCR have been described herein. While useful for teaching its manufacture and use, it is understood that the examples disclosed herein are non-limiting examples of an invention that can be variably practiced within the scope of the appended claims. Additional embodiments will occur to those skilled in the art. Although the invention has been discussed with respect to specific embodiment thereof, the embodiments are merely illustrative, not restrictive of the invention. Numerous specific details are provided, such as examples of components and methods, to provide a thorough understanding of the invention. One skilled in the relevant art will recognize, however, that an embodiment of the invention can be practiced without one or more of the specific details, or with other apparatus, systems, methods, components and/or the like. In other instances, well-known structures or operations are not specifically shown or described in detail to avoid obscuring aspects of embodiments of the present invention. Reference throughout this specification to "one embodiment", "an embodiment", "example embodiment", or "specific embodiment" does not necessarily reference the same embodiment, and furthermore means that a particular feature, structure or characteristic described in connection with the embodiment is included in at least one embodiment of the present invention but not necessarily in all embodiments.

It will also be appreciated that one or more of the elements depicted in the drawings can also be implemented in a more separated or integrated manner, or even removed, as is useful in accordance with a particular application. Likewise, process steps shown in a sequential order are not limited to the order shown, but may in some cases be performed in a different order. As used in the description herein and throughout the claims that follow, "a", "an" and "the" include plural references unless the context dictates otherwise.

What is claimed:

1. An apparatus, comprising:

A unitary base configured to receive a first electrical cable and a second electrical cable, said first electrical cable comprising at least a first hot wire and a first ground wire within a first cable sheath, said second electrical cable comprising at least a second hot wire and a second ground wire within a second cable sheath;

wherein said base is configured with a first ground contact for a ground connection with said first ground wire of said first electrical cable and a second ground contact for a ground connection with said second ground wire of said second electrical cable; and wherein said apparatus is configured to receive an electrical plug.

2. The apparatus of claim 1, wherein said first ground contact comprises a first ground contact screw and said second ground contact comprises a second ground contact screw.

3. The apparatus of claim 1, wherein said base is configured for electrical connection with a metal clad cable.

4. The apparatus of claim 1, wherein said base is configured for electrical connection with a non-metal sheath cable.

5. The apparatus of claim 1, wherein said first ground contact comprises an extended ground clip comprising an extension of said first ground contact configured to extend adjacent a metal sheath of said first electrical cable to provide an electrical connection between said metal sheath and said first ground contact.

6. The apparatus of claim 1, configured to electrically couple said first ground wire of said first electrical cable with said second ground wire of said second electrical cable.

7. The apparatus of claim 1, further comprising a door configured to couple to said base and cover one of said first and second ground contacts.

8. The apparatus of claim 1, wherein said base comprises a divider portion having a first face configured for receiving said first electrical cable, and an opposing face configured for receiving said second electrical cable, and wherein said first ground contact is disposed at said divider first face, and said second ground contact is disposed at said divider opposing face.

9. The apparatus of claim 1, wherein said apparatus is configured to provide power to a coupled device by electrically coupling a power supply cable to said plug without an intervening junction box.

* * * * *